US005142608A

United States Patent [19]

Meshekow

[11] Patent Number: 5,142,608

[45] Date of Patent: Aug. 25, 1992

[54] HORIZONTAL STEAM GENERATOR FOR OIL WELLS

[75] Inventor: Robert L. Meshekow, Los Angeles, Calif.

[73] Assignee: Meshekow Oil Recovery Corp., Beverly Hills, Calif.

[21] Appl. No.: 692,898

[22] Filed: Apr. 29, 1991

[51] Int. Cl.[5] ..... E21B 7/15; E21B 36/04; H05B 3/02; H05B 3/78

[52] U.S. Cl. ..... 392/303; 166/50; 166/60

[58] Field of Search ..... 392/301-303, 392/324, 325, 338, 394, 397; 166/302, 303, 50, 60, 59, 57; 175/16, 17, 283, 284, 231, 424; 165/45; 405/131

[56] References Cited

U.S. PATENT DOCUMENTS

| | | | |
|---|---|---|---|
| 884,424 | 4/1908 | Seymour et al. | 392/303 |
| 1,028,912 | 6/1912 | Schoenbroon | 392/325 |
| 1,258,642 | 3/1918 | Bergeron | 392/324 |
| 1,661,971 | 3/1928 | Seymour, Sr. | 392/303 |
| 2,350,429 | 6/1944 | Troupe | 166/60 |
| 2,771,954 | 11/1956 | Jenks et al. | 166/302 |
| 2,857,002 | 10/1958 | Pevere et al. | 166/303 |
| 3,095,012 | 6/1963 | McShane | 392/401 |
| 3,585,362 | 6/1971 | Hoogesteger | 219/427 |
| 3,994,340 | 11/1976 | Anderson et al. | 166/57 |
| 4,147,216 | 4/1979 | Schnepfe, Jr. et al. | 166/297 |
| 4,160,481 | 7/1979 | Turk et al. | 166/303 |
| 4,344,488 | 8/1982 | Marks | 166/303 |
| 4,378,846 | 4/1983 | Brock | 166/303 |
| 4,463,803 | 8/1984 | Wyatt | 166/303 |
| 4,511,000 | 4/1985 | Mims | 166/303 |
| 4,532,994 | 8/1985 | Toma et al. | 166/303 |
| 4,640,359 | 2/1987 | Livesey et al. | 166/303 |
| 4,783,585 | 11/1988 | Meshekow | 166/61 |
| 4,878,539 | 11/1989 | Anders | 166/303 |
| 4,914,275 | 4/1990 | Kramer | 392/401 |

*Primary Examiner*—Bruce A. Reynolds
*Assistant Examiner*—John A. Jeffery
*Attorney, Agent, or Firm*—Harlan P. Huebner

[57] ABSTRACT

A downhole steam and hot water generator for use in other than a non-vertical oil well casing and particularly adapted for use in horizontal drilled wells that includes an elongated housing with a front and rear end, fluid discharge apparatus positioned in the upper portion of said housing connected to an upper chamber therein, water distribution apparatus associated with the housing to pass water into the lower portion of the housing, and electrodes within said water to boil or vaporize water into steam for transfer to a horizontal petroleum pool to reduce the viscosity of the petroleum for pumping.

12 Claims, 3 Drawing Sheets

HORIZONTAL STEAM GENERATOR FOR OIL WELLS

FIELD OF THE INVENTION

This invention relates to steam or hot water generators for use in oil wells that have been drilled generally horizontal or non-vertical.

DESCRIPTION OF THE PRIOR ART

In vertical conventionally drilled oil wells the steam or hot water generator as covered in my U.S. Pat. No. 4,783,585 issued Nov. 8, 1988 has been adequate to accomplish the desired result.

However, with the advent of what is known as "horizontal drilling" the drilling from the surface will extend downward and curve from the vertical until a horizontal pool of oil is encountered. Such drilling will end up some lateral distance away from a vertical line down from the drilling rig. At the point a horizontal oil pool is engaged the drilling string extends generally horizontal. In addition the core casing will be horizontal.

SUMMARY OF THE INVENTION

It will be appreciated that while there are heater devices for use in vertical strings to reduce the viscosity of the oil for pumping the same, those structures may not be used on horizontal due to internal design and function and limited area of for dispensing steam or hot water. Further the prior art devices cannot be reconstructed to dispense steam and hot water from the elongated tube structures.

SUMMARY OF THE INVENTION

It is the purpose of the present invention to provide a downhole steam or hot water generator that includes structure wherein the generator may be placed horizontally or nearly so or off vertical to dispense the steam.

Another object of the present invention is to provide a horizontal downhole steam or hot water generator that includes a horizontal chamber for the steam or hot water and appropriate openings to dispense the steam or water to the casing and therethrough into the oil formation to thin the same for pumping.

A still further object of the present invention is to provide a horizontal downhole steam or hot water generator having electrodes therein which can effectively, when energized, heat incoming water to boiling and steam.

Another object of the present invention is to provide a horizontal downhole steam or hot water generator that employs various steam or water dispensing means to distribute the same.

A further object of the present invention is to provide a horizontal downhole steam or hot water generator that employs a housing that is fitted with electrodes and adapted to receive water will be heated by the electrodes to form the steam or hot for passage into the horizontal oil formation.

These and other objects and advantages will become apparent from the following part of the specification wherein details have been described for the competence of disclosure, intending to limit the scope of the invention which is set forth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
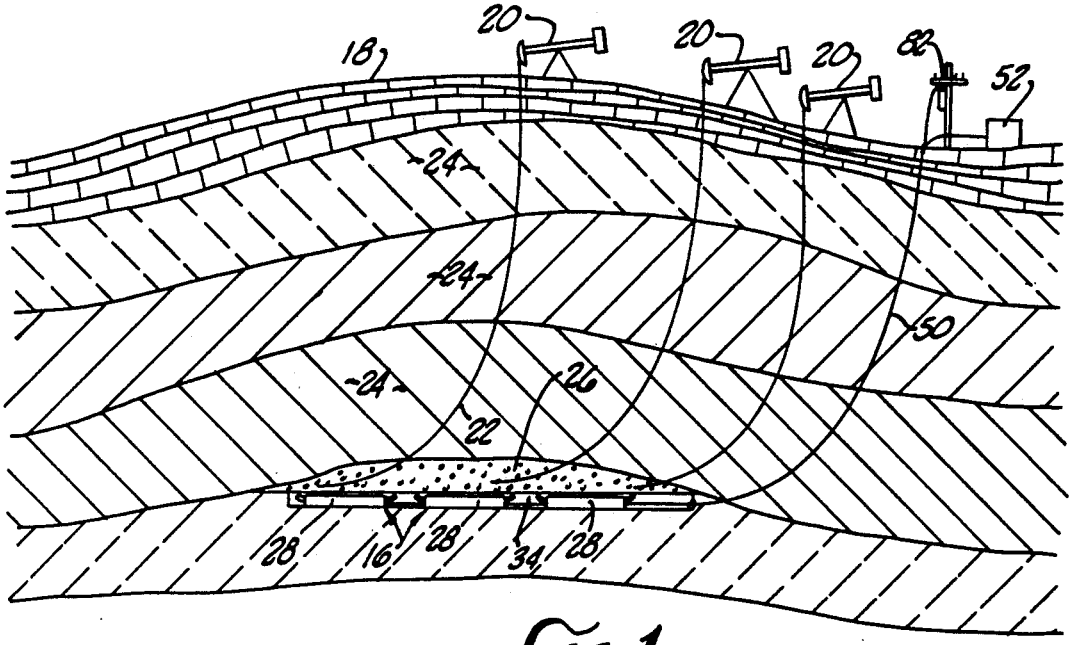
FIG. 1 is an environmental view of the horizontal downhole steam or hot water generator of the present invention.

In FIG. 1 there is illustrated a cutaway environmental illustration of a number of horizontal downhole steam or hot water generators generally designated 16. On the surface 18 of the ground there are shown several conventional oil pumping rocker arms 20 each with a conventional string or oil bore casing 22 within which is a sucker rod or other pumping system (not shown) to draw the petroleum hydrocarbons up the casing 22 to surface 18.

The illustrations of FIG. 1 represent the newer technology of what is commonly referred to as horizontal drilling; that is, the drilling and in turn the casing 22 moves downwardly from surface 18 and curvingly from the vertical through various earth strata 24 becoming more arcuate as the drilling progresses to engage what is commonly referred to as a horizontal pool of petroleum hydrocarbons 26 or oil.

The pool 26 can vary in horizontal length and in vertical thickness thus several pumps 20 many be needed to extract the oil from the pool 26.

With the advent of the new technology for tapping horizontal pools 26, oil of varying viscosity will be encountered. Therefore, as with any underground oil formation, the higher the viscosity the greater strain on the pumping apparatus to move the oil up the string 22.

As has been known in vertical oil drilling the viscosity of subterranean oil can be reduced by the use of steam or hot water generators. However, such generators as protected by U.S. Pat. No. 4,783,585 would not properly function in a horizontal or other than vertical position.

In FIG. 1 the arrangement shows the oil pumping function and steaming function with new generator 16 to be separate operations This generally is the situation when the generator 16 is "steaming" all year long and the oil is also being pumped continually. This is known as "steam drive". On the other hand if the "steaming" is geared only to take place intermittently or cyclically then the generator 16 is usually placed at the end of the string 22. This is known as "huff" and "buff" steaming. However, whichever technique is being used in the well the new generator 16 and its modifications will remain the same.

Figure 2:
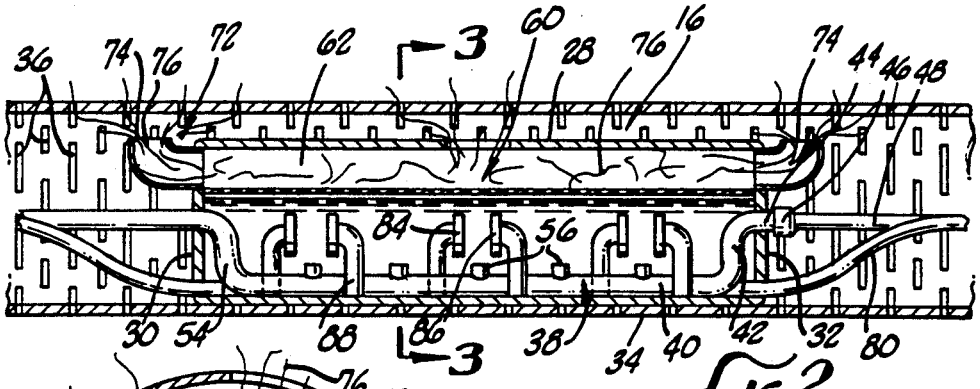
FIG. 2 is a side elevational cross sectional view of a single generator of the present invention horizontally positioned within an oil well casing.
Figure 3:
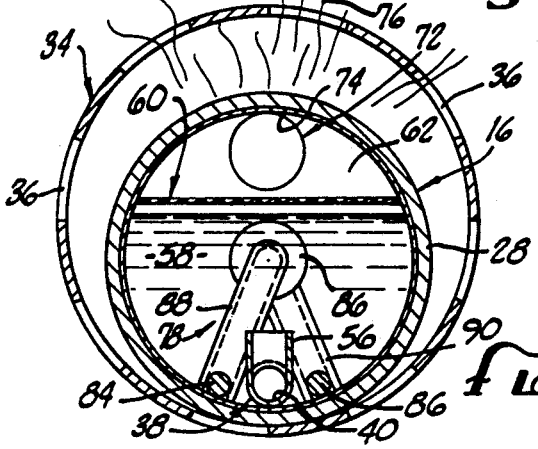
FIG. 3 is a cross sectional view of the present taken on line 3—3 of FIG. 2.
Figure 4A:
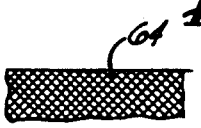
FIGS. 4*a*, 4*b* and 4*c* are different types water barriers of wire meshing or openings in a generator housing to restrict the water therein from entering a steam chamber in the upper part of the housing when in a generally horizontal position.
Figure 4B:
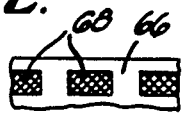
Figure 4C:
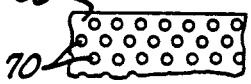

The generator 16 includes an elongated housing 28, best seen in FIGS. 2 and 3 which is preferably annular with a front end 30 and a rear end 32 to close the housing 28. The housing 28 is lowered by conventional means until it rests in the casing 34 within the pool 26. The casing is preferably provided with a plurality of slits or slots 36 therefound to allow steam or hot water to escape into the petroleum to reduce the viscosity thereof. Generally speaking casing 34 may vary in diameter between 5" to 9⅝ and in standard well tubing between 3" to 7". Thus, the diameter of the housing 28 will vary from 2.75" to 9.00".

Mounted within the housing 28 there is a water distribution means designated 38 which is seen in FIGS. 2, 3 through 9. There is a water manifold on pipe 40 that preferably extends the length of the housing and is bent upwardly unusually at the rear end forming a coupling connector section 42. It exits the housing generally in the central portion of the rear end 32 and terminates in an end 44 that receives a coupling 46 which unites the manifold 40 with a water distribution pipe 48. The pipe will extend up the casing represented by line 50 of FIG. 1 to a water pumping means 52 on surface 18.

Figure 8A:
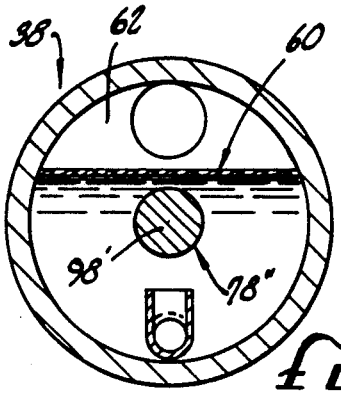
FIG. 8*a* is a cross sectional view of the generator of FIG. 8 taken on lines 8*a*–8*a* thereof.
Figure 8:
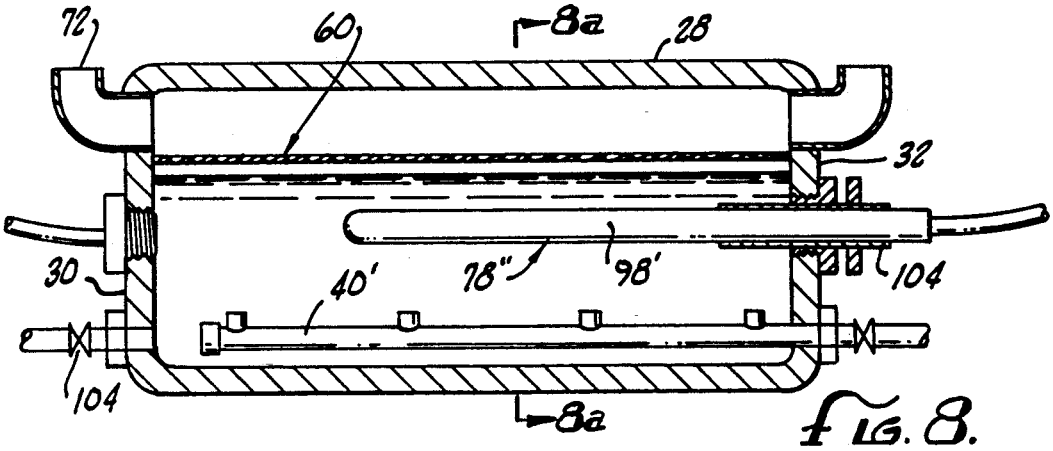
FIG. 8 is a side elevational cross sectional view of a horizontal downhole steam or hot water generator illustrating a still further modified electrode arrangement for heating water

The forward end 54 of the manifold 40 may be bent upwardly and project through end wall 30 to an adjoining housing 28 (See FIG. 1) as in FIGS. 2, 5, 6 and 9 or terminate within the housing 28 as seen in FIG. 8 where only one generator 16 is to be used.

The manifold 28 is fitted with a plurality of water openings 56 therealong to allow water 58 to flow into the housing for conversion to steam or to hot water.

Extending across the interior of the housing 28 and throughout its length there is a water barrier designated 60. The purpose of the barrier 60 is to prevent or dampen "pool swell" of boiling water 58 above the barrier 60 into a steam chamber 62. The barrier 60 is preferably a mesh screen 64 (See FIG. 4*a*) or may be a metallic sheet 66 with either sections of mesh screen 68 fitted therein or a plurality of holes 70.

The height of the barrier 60 as seen in FIGS. 2 and 3 is slightly lower than steam discharge means 72. The means is preferably upturned pipes 74 that extends from the respective ends and 32 to allow steam 76 to pass out the slots 36 of the casing 34. However, where boiling water is desired to be put into the formation then the barrier 60 is removed so the water may exit.

In order to boil the water 58 or to make the steam 76 there are a plurality of positive and negative power electrode means designated 78 that are mounted in the housing preferably in the area of water discharge from pipe 40.

The electrode means 78 are energized by a power line 80 which extends upward to surface 18 through line 50 to a conventional electrical transformer 82 on the ground surface 18. The power line 80 is a two part line that has positive line 84 and negative line 86 (See FIG. 3.)

In FIG. 2 the means 78 are a pair of opposed positive and negative disks 84 and 86 which are suspended from arms 88 and 90 through which the current runs to the disks. When the disks 84 and 86 are energized the surrounding water 58 will be heated to boiling or to evaporation giving off steam 76 or water for discharge into the oil formation 26.

Due to the fact that the housing 28 operates on the horizontal or near horizontal the water area is elongated and a plurality of electrode means 78 may be desired along the interior to assure the necessary steaming along the entire steam chamber 62.

In addition as shown in FIG. 1, the pool 26 configuration may be such as to require several generators 28 in tandem to effectively reduce the viscosity.

Figure 5:
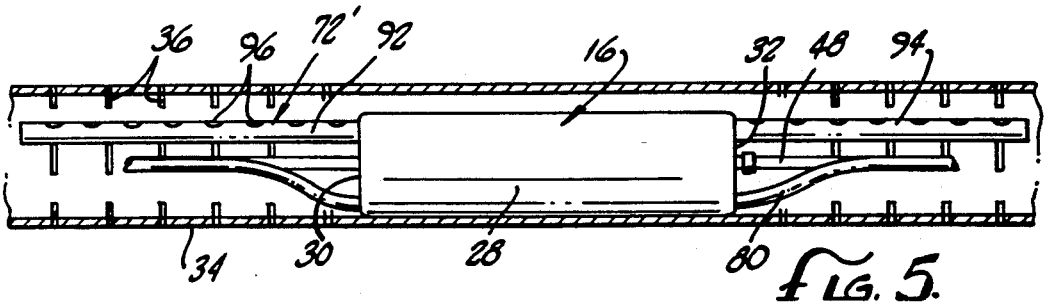
FIG. 5 is a side elevational cross sectional view of the downhole horizontal steam or hot water generator showing telescoping steam release manifolds.

In FIG. 5 there is illustrated a modified steam or hot water discharge means 72' within the housing 28. The means 72' includes a pair of telescoping steam or hot water manifolds 92 and 94 each with steam openings 96. The manifolds 92 and 94 may be constructed so that as the housing 28 is lowered into position in the non-vertical drilling string the manifolds 92 and 94 are within the housing 28 so it can negotiate curves encountered in horizontal drilling. When the housing 28 arrives at the designated position in casing 34 by appropriate means the manifolds are urged outwardly from the ends 30 and 32 of the generator 16. Such a structure will be capable of reaching a larger area of the oil pool 26 for steaming. Also such structure will reduce the number of generators 16 needed for a given job.

Figure 6:
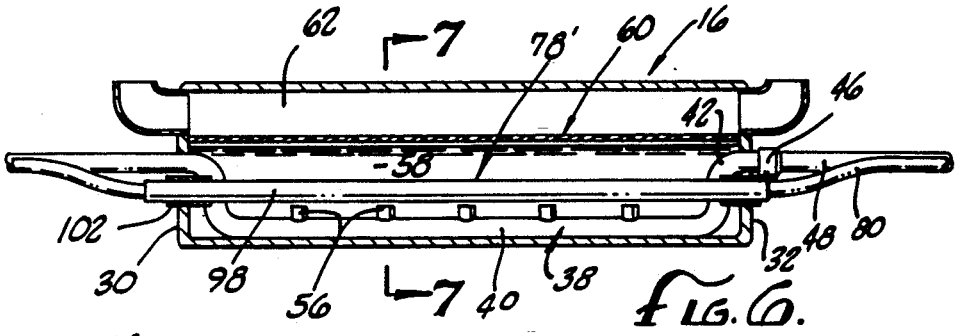
FIG. 6 is a side elevational cross sectional view of a horizontal downhole steam or hot water generator illustrating a electrode arrangement for heating water therein.
Figure 7:
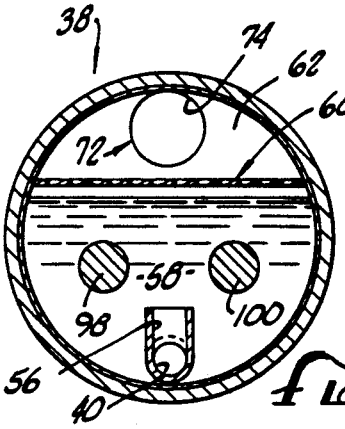
FIG. 7 is a cross sectional view of the steam or hot water generator of FIG. 6 taken on lines 7—7 thereof.

FIGS. 6 and 7 are directed to a first modification of the electrode means 78' wherein a pair of positive and negative rods 98 and 100 are energized through line 80. Here the rods 98 and 100 extend lengthwise through ends 30 and 32 of the housing 28. There is appropriate insulation 102 to separate the electrodes from the housing 28.

The generator 16 of FIGS. 8 and 8*a* includes the previously described housing 28, ends 30 and 32 steam or hot water discharge means 72 and barrier 60. However, the difference resides in electrode means 78" wherein there is a single positive electrode rod 98' that extends partially through the housing. The negative electrode is the housing 28 itself, so that water 58 between the rod 98' and housing when energized will heat. Here there is insulation 104 between the rod and housing so as to not short out the electrodes. The water inlet manifold 40 may stop within the housing as in FIG.

9 or stop as FIG. 8 with an outlet valve 104 to take water from the housing 28 to another or a separate water conveyor may be used.

Figure 9:
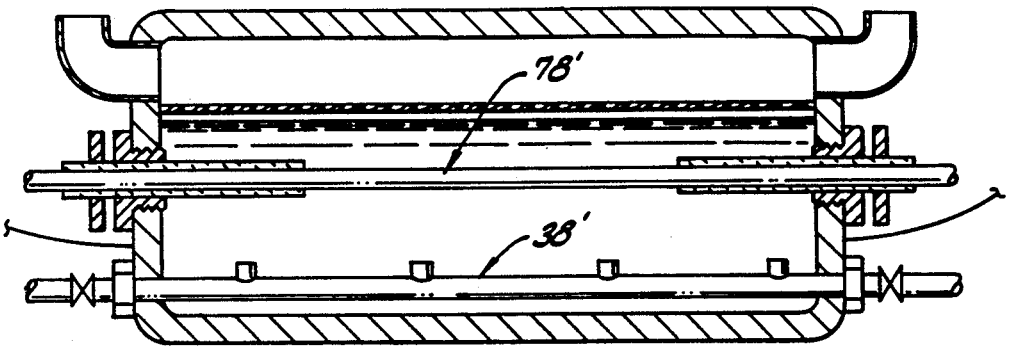
FIG. 9 is a side elevational cross sectional view of a horizontal downhole steam or hot water generator illustrating structure for uniting with another generator in tandem.

FIG. 9 is a composite of the previously discussed housing 28 as in FIG. 8 with the exception that the water manifold means 38 and electrode means 78 may extend through the housing and continue to an adjoining generator not shown.

Figure 10:
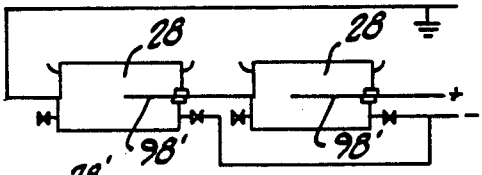
FIG. 10 is a schematic representation of the wiring of two or more generators in series.
Figure 11:
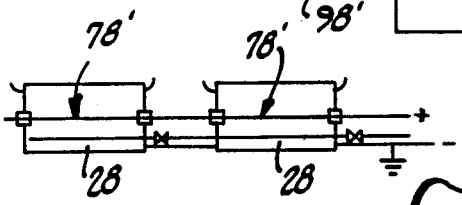
FIG. 11 is a schematic representation of the wiring of two or more generators in parallel.

In FIGS. 10 and 11 the schematics, show the system rigged in series and in parallel respectively.

Figure 13A:
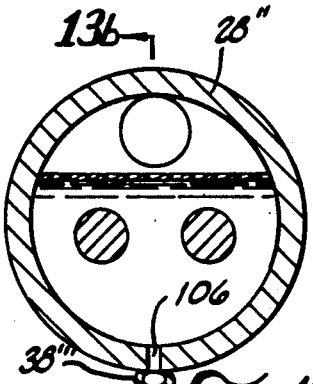
FIG. 13*a* is a cross sectional view of the generator of this invention with the further modified placement of a water line to the generator.
Figure 12A:
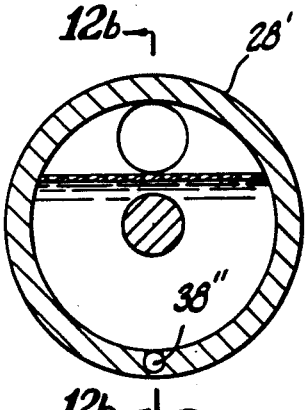
FIG. 12*a* is a cross sectional view of the steam or hot water generator of this invention with a modified placement of a water line to the generator.
Figure 12B:
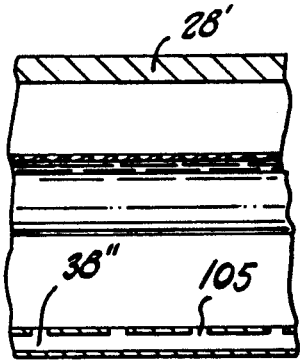
FIG. 12*b* is a side elevational cross sectional view partly in section of the generator taken on lines 12*b*–12*b* of FIG. 12*a;*
Figure 13B:
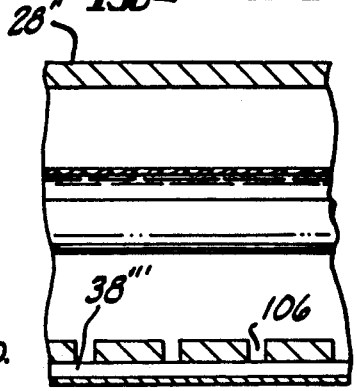
FIG. 13*b* is a side elevational cross sectional view partly in section of the generator taken on lines 13*b*—13*b* of FIG. 13*a*.

The modifications in FIGS. 12 through 13*b* illustrate a modified housing 28' and 28''. In the FIG. 12*a* modification the wall of the housing 28' is made thicker with the water manifold 38'' passing along an elongated axis within the wall with water outlets 105 into the housing 28'.

FIGS. 13*a* and 13*b* illustrate the manifold 38''' as an appendage to the wall of the housing 28'' with bores 106 passing through the housing wall to pass water into the housing.

The electrodes may be a carbon such as graphite, however, the inventor is not limited to such material.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. In a horizontal steam or hot water generator for use in non-vertical drilled oil wells having an annular-walled housing with an elongated axis adapted to pass down from ground level through a relatively small diameter casing having openings therein and cable means to raise and lower said generator in the casing to an area wherein said elongated axis is generally horizontal and to an area where it is desired to apply steam or hot water through the opening in the casing into a generally elongated horizontal petroleum pool, the improvement comprising:

said annular-walled housing having a front and a rear end to close said housing and said elongated axis runs between said ends and said length of said housing is greater than the diameter of said housing when said housing is in an operating position, and said housing having an elongated upper chamber between said ends for steam or boiling water and a lower elongated water reservoir between said ends;

electrode means within said housing in said water reservoir and means adapted to extend to ground level to energize said electrode means to heat the water; and fluid discharge means that includes a pipe diversion port projecting from at least one end of said housing, said port communicating with said upper chamber and aimed toward the casing to allow fluid in said chamber to pass out of said housing and the openings of the casing into the petroleum formation to heat the same and change the viscosity of oil in the formation.

2. A horizontal steam or hot water generator as defined in claim 1 wherein:

an elongated water barrier is positioned in said housing between said ends to divide said elongated upper chamber and said elongated lower water reservoir.

3. A horizontal steam or hot water generator as defined in claim 2 wherein:

said elongated water barrier is a screen that will allow steam to pass therethrough yet restrict the upward movement of water as it is boiling.

4. A horizontal steam or hot water generator as defined in claim 1 wherein:

said electrode means includes t least one pair of electrode disks in spaced apart facing relationship which upon energization will heat water in the vicinity of said pair.

5. A horizontal steam or hot water generator as defined in claim 1 wherein:

said electrode means includes a pair of electrode rods mounted within said reservoir and said rods extend a length greater than one-half the length of said housing.

6. A horizontal steam or hot water generator as defined in claim 1 wherein:

said electrode means includes said housing as one of said electrodes and the second electrodes being a rod mounted within said water reservoir.

7. A horizontal steam or hot water generator as defined in claim 4 wherein there are a plurality of pairs of electrode disks mounted in said housing within said reservoir.

8. A horizontal steam or hot water generator as defined in claim 1 wherein:

there are two pipe diversion ports one projecting from each end of said housing.

9. A horizontal steam or hot water generator as defined in claim 1 wherein:

said fluid discharge means includes a telescoping manifold adapted to project outwardly from one of said ends and communicating with said upper chamber, said manifold adapted to enlarge the area of fluid contact in said petroleum deposit.

10. A horizontal steam or hot water generator as defined in claim 1 wherein:

said water supply fluid discharge means is a manifold positioned within said housing in said water reservoir area.

11. A horizontal steam or hot water generator as defined in claim 1 wherein:

said water supply means is formed within the wall of said housing and includes a number of ports passing through said wall into said housing to allow water to flow into said water reservoir.

12. A horizontal steam or hot water generator as defined in claim 1 wherein:

said water supply means is a pipe mounted on the exterior of said housing at the lower portion thereof and a plurality of ports pass through the wall of said housing whereby the pipe and said water reservoir are in communication.

* * * * *